US006598549B1

(12) United States Patent
Voegeli

(10) Patent No.: US 6,598,549 B1
(45) Date of Patent: Jul. 29, 2003

(54) BOAT LIFT

(75) Inventor: Ronald C. Voegeli, 651 Spruce Creek Rd., Breckenridge, CO (US) 80424

(73) Assignee: Ronald C. Voegeli, Anacortes, WA (US)

( * ) Notice: Subject to any disclaimer, the term of this patent is extended or adjusted under 35 U.S.C. 154(b) by 0 days.

(21) Appl. No.: 10/101,223

(22) Filed: Mar. 20, 2002

(51) Int. Cl.[7] ..... B63C 7/00
(52) U.S. Cl. ..... 114/44; 114/48; 405/3
(58) Field of Search ..... 114/44, 48, 50; 405/1, 3

(56) References Cited

U.S. PATENT DOCUMENTS 3,675,258 A 7/1972 Osmundson
4,641,996 A 2/1987 Seal
4,850,741 A * 7/1989 Timmerman ..... 405/3
4,900,187 A 2/1990 Uchida et al.
5,485,798 A * 1/1996 Samoian et al. ..... 114/44
5,803,003 A 9/1998 Vickers
5,890,835 A * 4/1999 Basta et al. ..... 405/3
5,908,264 A * 6/1999 Hey ..... 405/3

* cited by examiner

*Primary Examiner*—Jesus D. Sotelo
(74) *Attorney, Agent, or Firm*—Burns, Doane, Swecker & Mathis, L.L.P.

(57) ABSTRACT

A boat lift includes a base mounted on land adjacent to a body of water, a swinging frame mounted to the base by a first swinging coupling, a boat-supporting frame mounted to the swinging frame by a second swinging coupling, and an actuator for causing the swinging frame to swing relative to the base about the first swinging coupling. Thus, the boat-supporting frame moves upwardly and inwardly to a boat-storage position, or downwardly and outwardly to a boat-launch position, depending upon the direction of swinging motion of the swinging frame. The swinging frame and the boat-supporting frame together form a walkway arranged for providing access between the shoreline and the boat-supporting structure when the boat-supporting frame is in its boat-launch position.

16 Claims, 4 Drawing Sheets

BOAT LIFT

BACKGROUND OF THE INVENTION

The present invention relates to a boat lift apparatus for raising and lowering a boat at a seawall.

It is common to dock boats at piers that project into the water from a shoreline. Raising and lowering the boat can be accomplished by a vertical hoist mechanism which moves the boat vertically, e.g., by raising and lowering a boat-carrying cradle in a vertical direction as disclosed in U.S. Pat. Nos. 4,900,187 and 5,803,003. Such vertical hoists are suitable for use in cases where the water beneath the cradle is deeper than the boat displacement. However, in many situations the water is very shallow at a location beneath the cradle and becomes progressively deeper away from the lifting mechanism. Such a condition may occur along a seawall that follows the shoreline. Vertical hoists are not useful under those conditions.

In many places, local ordinances prohibit the construction of docks along the seawall, thereby making it difficult to raise and lower a boat due to the need to displace the boat not only downwardly but also outwardly to the deeper water when lowering the boat. Conversely, the boat must be not only be moved upwardly, but inwardly toward the seawall when raising the boat. Moreover, it becomes more difficult to enter the boat once it has been lowered, since it has been moved away from the seawall.

Various boat lifting apparatus have been proposed which result in the boat being moved toward a seawall when raised, and moved away from the seawall when lowered, e.g., see U.S. Pat. Nos. 4,641,996 and 3,675,258. U.S. Pat. No. 4,641,996 discloses rails inclined downwardly and outwardly from a seawall, and a boat cradle slidable along the rails. A shortcoming of such an apparatus involves the fact that the rails are permanent installations, wherein lower ends of the rails are anchored in pilings. Such permanent submerged installations are not only expensive to install, but may be prohibited in many localities.

In U.S. Pat. No. 3,675,258 a boat hoist is disclosed in which a boat supporting platform is connected to an outer end of a scissor apparatus, an inner end of which is connected to a vertical side of a seawall. When the scissor apparatus is extended, its outer end is in a lowered state to enable the platform to load (or unload) a boat. A cable mechanism is connected to the scissor mechanism for collapsing the scissor mechanism, whereby the platform is brought toward the seawall while simultaneously being raised. A shortcoming exhibited by this boat hoist is that since the inner end of the scissor apparatus is mounted on a vertical side of the seawall, a great moment is applied to the mounting when the scissor apparatus is in a collapsed boat-storing state. Thus, exceptional measures would have to be taken to strengthen this mount. Furthermore, when a boat approaches the hoist from the water, it is impossible for a boat occupant to leave the boat and directly enter the seawall to activate the hoist. Likewise, once a user activates the hoist to cause a raised boat to be lowered into the water, it is impossible for the user to directly enter the boat from the seawall. Accordingly, this type of hoist is of limited usefulness.

Therefore, it would be desirable to provide a boat lift adapted to move a boat not only up-and-down, but also away from a seawall when lowering the boat and toward the seawall when raising the boat. Such a boat lift should not involve any permanent submerged structures and should facilitate access to and from the boat when the boat is in a floating (launched) state. Also, any moments applied to an anchoring structure of the boat lift should be minimized when the boat is held in a raised state.

SUMMARY OF THE INVENTION

The present invention relates to a boat lift which comprises a base that is anchored adjacent to a shoreline of a body of water. A frame structure is provided for raising a boat from the water and lowering a boat into the water. The frame structure includes a swinging frame and a boat-supporting frame. The swinging frame has inner and outer ends. The inner end is swingably attached to the base by a first swinging coupling. The boat-supporting frame has proximate and remote ends. The proximate end is swingably attached to the swinging frame adjacent the outer end thereof. A section of the boat-supporting frame disposed adjacent the remote end thereof defines a boat-supporting structure arranged to support an underside of a boat. The boat lift further includes an actuator operably connected to the frame structure for causing the swinging frame to swing relative to the base about the first swinging coupling, wherein the boat-supporting frame moves upwardly and inwardly toward the base to a boat-storage position when the swinging frame swings in one direction. The boat-supporting frame moves downwardly and outwardly away from the base to a boat-launch position when the swinging frame swings in an opposite direction. The boat supporting structure remains in a substantially horizontal state during up-and-down movement of the boat supporting frame. The frame structure forms a walkway arranged for providing users with access between the shoreline and the boat-supporting structure when the boat-supporting frame is in its boat-launch position.

In another aspect of the invention, a boat lift comprises a rigid support structure anchored on land adjacent to a body of water. The support structure includes a horizontal portion disposed over the land. A base is mounted on the horizontal portion of the support structure. A frame structure is provided for moving a boat between raised and lowered positions. The frame structure includes a swinging frame, a boat supporting frame, and a stabilizing structure. The swinging frame includes a pair of parallel, spaced apart base arms. Each base arm includes an inner end mounted to the base by a first swinging coupling, enabling an outer end of each base arm to swing upwardly and inwardly, or downwardly and outwardly, depending upon a direction of swinging movement of a swinging frame. The boat-supporting frame includes a pair of parallel, space apart support arms. Each support arm includes a proximate end mounting directly to an outer end of a respective base arm by a second swinging coupling. The support arms include respective remote portions arranged for supporting an underside of a boat. The stabilizing structure is connected to the boat-supporting frame for maintaining the remote portions in a horizontal state during up-and-down movement of the boat-supporting frame. An actuator is operably connected to the frame structure for causing the swinging frame to swing relative to the base about the first swinging coupling. The boat-supporting frame thus moves upwardly and inwardly toward the base to a boat-storage position when the swinging frame swings in one direction. The boat-supporting frame moves downwardly and outwardly to a boat-launch position when the swinging frame swings in an opposite direction. The first and second swinging couplings are disposed in vertically overlying relationship to the horizontal portion of the support structure when the boat-supporting frame is in its boat-storage position.

In a further aspect of the invention, boat lift apparatus is mounted on a horizontal platform disposed on land. A front portion of the platform underlies a rear portion of a top ap of a seawall.

BRIEF DESCRIPTION OF THE DRAWINGS

The objects and advantages of the invention will become apparent from the following detailed description of a preferred embodiment thereof in connection with accompanying drawing in which like numerals designate like elements and in which.

DETAILED DESCRIPTION OF A PREFERRED EMBODIMENT OF THE INVENTION

Figure 1:
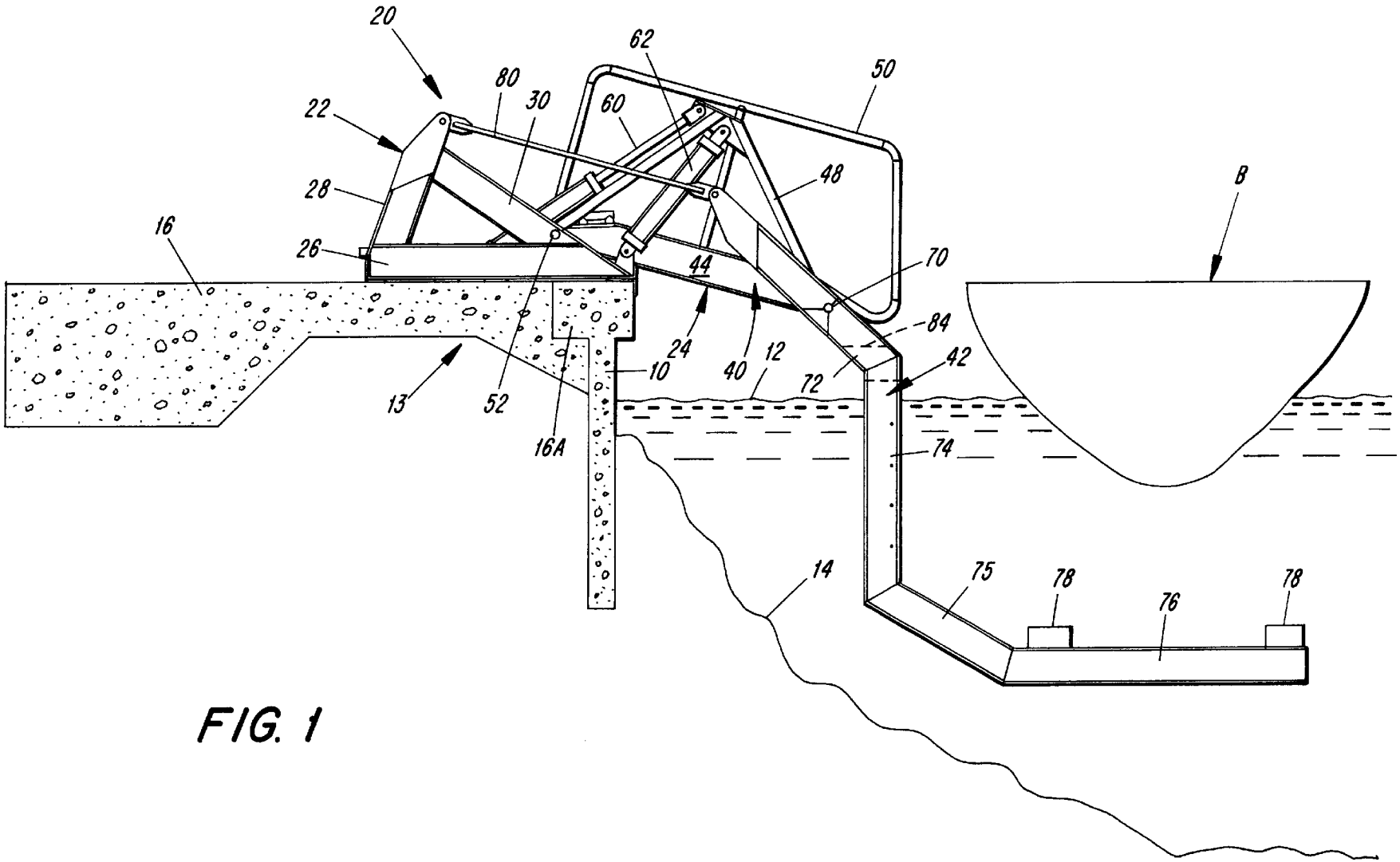
FIG. 1 is a side elevational view of a boat lift according to the present invention, in a boat-launch position.

Depicted in FIGS. 1–4 is a vertical seawall 10 disposed along a shoreline body of water 12. A seabed 14 of the body of water becomes progressively lower from the seawall, whereby the depth of the water body progressively increases. A concrete horizontal platform 16 is disposed at the seawall and is located above and adjacent the body of water. The seawall 10 and the platform 16 together define a rigid support structure 13.

In order to enable a boat B to be raised and lowered relative to the seawall, a boat lift apparatus 20 is provided. That apparatus is mounted on the concrete platform 16 and includes a base 22 and a frame assembly 24 connected thereto. Each side of the base is formed of steel and comprises a metal framework including: a horizontal beam 26 affixed to the concrete platform 16, an upstanding beam 28, and a reinforcing beam 30. Horizontal slats 32 disposed between the sides of the base form a section of a walkway to be explained (see FIG. 2).

The seawall 10 includes a vertical slab 10A and a cap 10B disposed at the upper end of the vertical slab. A front portion 16A of the platform 16 underlies a rear portion of the cap 10B, thereby resisting downward movement of the seawall 10 under the weight of the apparatus 20. The cap 10B is effectively locked between the apparatus 20, the front portion 16A of the platform 16, and the vertical slab 10A.

The frame assembly 24 includes a swinging frame 40 and a boat supporting frame 42 connected thereto. The swinging frame 40 is formed of steel and includes a pair of base beams 44 interconnected by slats 46 that form another section of a walkway. The swinging frame further includes a rigid arm structure 48, and a guard rail 50. The base beams 44 are connected at their inner ends to the base 22 by a swinging coupling in the form of a horizontal pivot pin 52 situated over the support structure. Thus, an outer free end of the swinging frame can move upwardly and inwardly when the swinging frame is raised, and can be moved downwardly and outwardly when the swinging frame is lowered.

Figure 2:
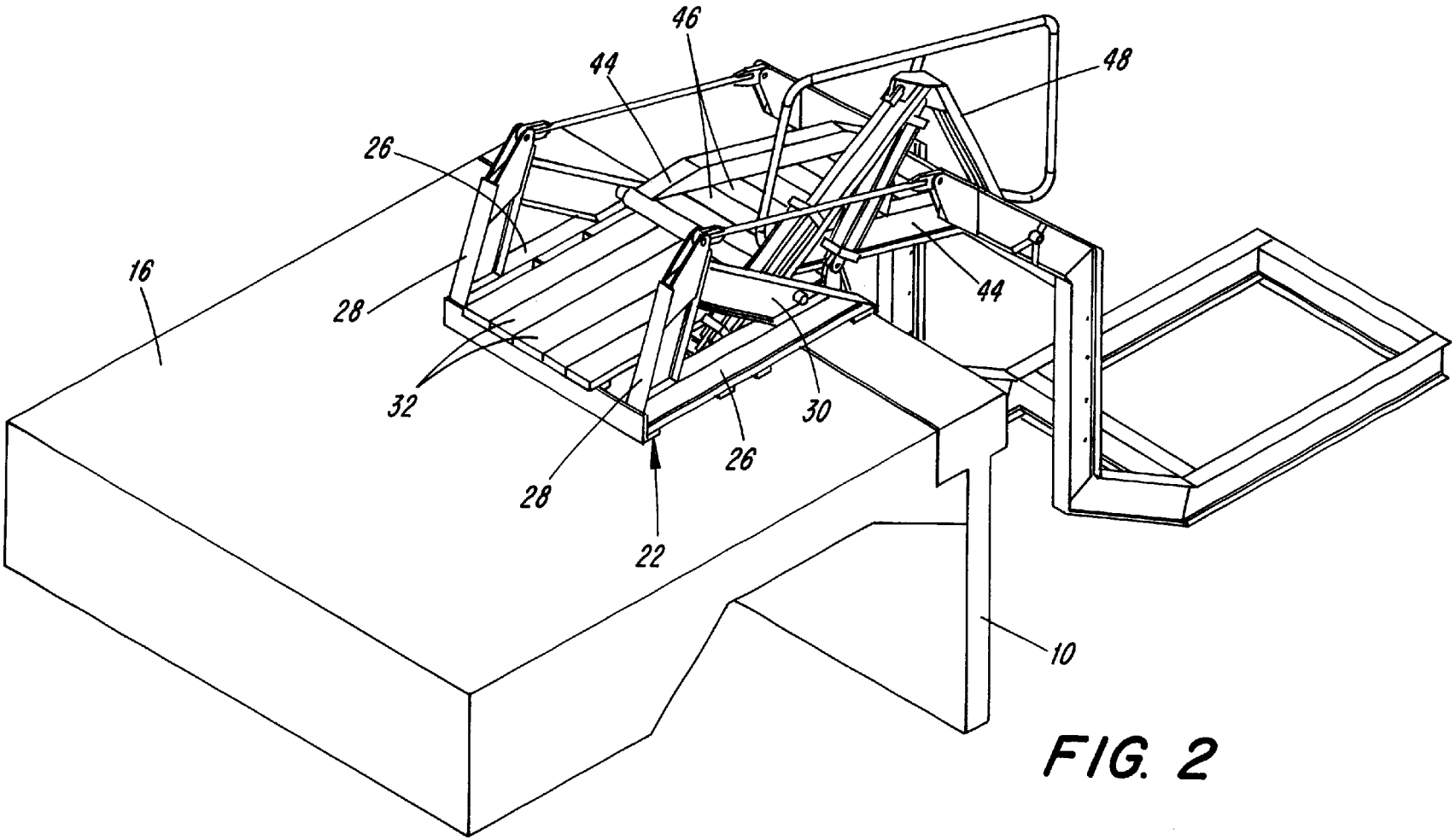
FIG. 2 is a top rear perspective view of FIG. 1.
Figure 3:
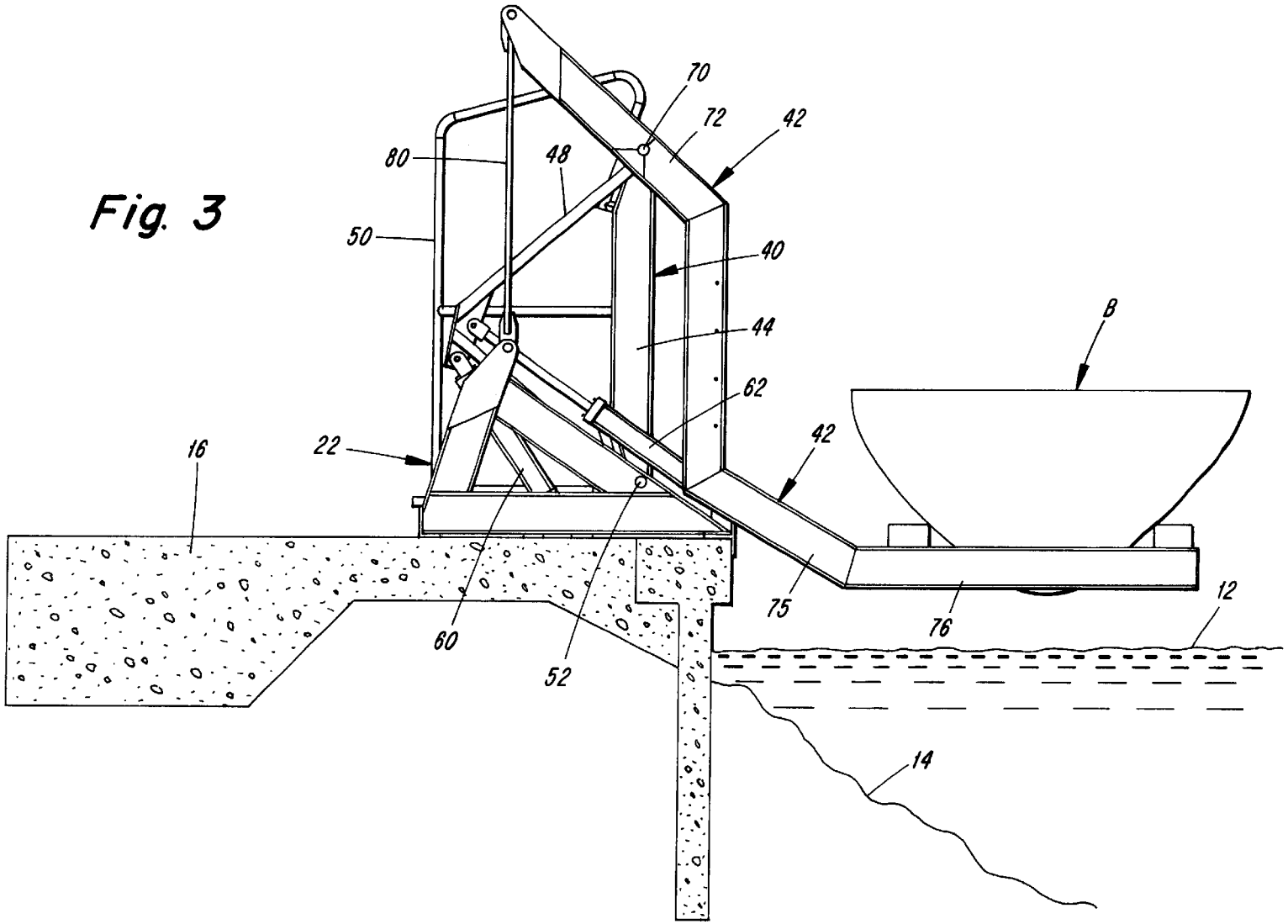
FIG. 3 is a side elevational view of the boat lift in a boat-storage position.
Figure 4:
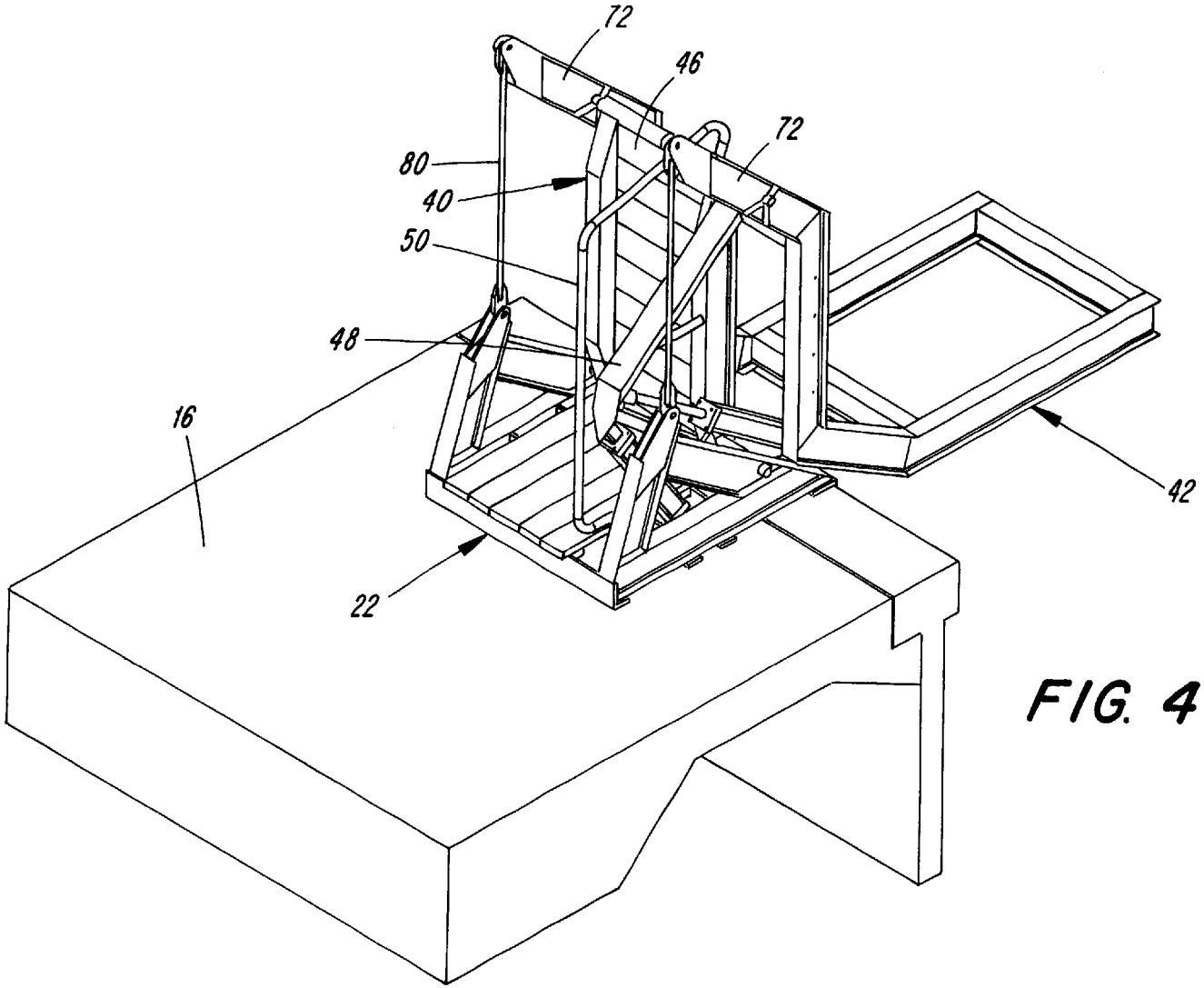
FIG. 4 is a top rear perspective view of FIG. 3.

Raising and lowering of the swinging frame is effected by a power actuator in the form of a conventional fluid piston-and-cylinder (i.e., fluid ram) arrangement comprising first and second piston-and-cylinder members 60, 62 each connected between a horizontal beam 26 of the base 22, and the arm structure 48 of the swinging frame. The members 60, 62 cooperate, in that one of the members 60, 62 is extended while the other is retracted, in order to exert a push/pull action on the swinging frame 40. Thus, the swinging frame 40 can be swung between a generally vertical state (FIGS. 3 and 4) and a generally horizontal state (FIGS. 1 and 2).

The piston-and-cylinder members 60, 62 are preferably hydraulically operated. Alternatively, other types of power actuators could be used, such as a motor driven cable for example.

The boat-supporting frame 42 has a proximate end connected to the swinging frame by a swinging coupling in the form of a horizontal pivot pin 70 that is disposed adjacent the outer end of the swinging frame 40. Thus, the pivot pin 70 moves upwardly and inwardly, or downwardly and outwardly along with that outer end.

The boat-supporting frame 42 includes a pair of first beams 72 that are inclined relative to vertical when the boat supporting frame 42 is in a lowered state, a pair of second beams 74 oriented vertically when the boat supporting frame 42 is in a lowered state, a pair of third beams 75, and a pair of horizontal fourth beams 76 oriented in a horizontal state when the boat supporting frame 42 is in a lowered state. A pair of raised chocks 78 extend across the fourth beams 76 adjacent a remote end of the boat-supporting frame 42 to define a boat-supporting cradle for supporting an underside of the boat B (the chocks 78 being shown only in FIGS. 1 and 3).

A pair of stabilizing arms 80 are connected between the base 22 and the boat supporting frame 42, in particular between the upright beams 28 of the base and the first beams 72 of the boat supporting frame 42. Accordingly, the stabilizing arms 80 and the base beams 44 of the boat supporting frame form a part of a parallelogram that ensures that the orientation of the boat supporting frame remains constant during swinging movement of the surviving frame. Thus, the chocks 78 of the outer portion 76 of the boat supporting frame always remain horizontal.

In practice, with the frame assembly 24 in its lowered or boat-launching state, and a floating boat B situated over the cradle chocks 78 (FIG. 1), an occupant of the boat can exit the boat and enter the seawall by walking along the walkway sections 32, 46 that are now generally aligned with one another. If the exited occupant wishes to raise the boat, he/she can then actuate the lift mechanism, whereupon the piston-and-cylinders 60, 62 are actuated to raise the frame assembly 24. That is, the piston-and-cylinder 60 is retracted, and the piston-and-cylinder 62 is extended. Consequently, the swinging frame 40 is swung (counterclockwise in FIG.1) to a generally vertical state, wherein the pivot pin 70 is raised and simultaneously moved inwardly. While that occurs, the boat supporting frame 42 remains in a constant orientation, with the cradle carrying outer portion 76 thereof remaining horizontal. As a result, the cradle-defining chocks 78 are raised to lift the boat out of the water. Simultaneously, the outer portion 76 moves inwardly so that the boat is not only raised, it is also moved inwardly toward the seawall to a boat-storing position (see FIG. 3).

The third beams 75 may have vertically spaced steps 84 (shown in broken lines in FIG. 1) extending thereacross to define an extension of the walkway which affords access to and from the boat. Those steps can extend along the entire height of the frame 42.

In order to place the boat in the water, wherein a user is situated at the seawall, the lift mechanism is operated in reverse, i.e., the operation of the actuator cylinders 60, 62 is reversed. Thus, the swinging frame 40 is swung clockwise in FIG. 1 to a generally horizontal state, whereupon the cradle-carrying portion 76 of the boat supporting frame is moved outwardly and downwardly to launch the boat into the water. Then, the user can enter the launched boat by walking along the walkway 32, 46.

It will be appreciated that the present invention enables a boat to be raised from, or lowered into, a water body without the need to provide a permanent submerged structure. Also, access to and from the boat is facilitated when the boat is in a lowered launched (floating) state, so that a single boat user can actuate the lift mechanism to raise or lower the boat.

In addition, when the boat is in a raised (stored) condition, the base beams 44 which resist the vertical load of the boat, are oriented vertically at a location overlying the supporting structure 13, so that any moment applied thereto is minimized.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A boat lift comprising:

a base anchored adjacent a shoreline of a body of water;

a frame structure for raising a boat from the water and lowering a boat into the water, the frame structure including:

a swinging frame having inner and outer ends, the inner end swingably attached to the base by a first swinging coupling, and a boat-supporting frame having proximate and remote ends, the proximate end swingably attached to the swinging frame by a second swinging coupling adjacent the outer end thereof, a section of the boat-supporting frame disposed adjacent the remote end thereof defining a boat supporting structure arranged to support an underside of a boat;

an actuator operably connected to the frame structure for causing the swinging frame to swing relative to the base about the first swinging coupling, wherein the boat supporting frame moves upwardly and inwardly toward the base to a boat-storage position when the swinging frame swings in one direction, and wherein the boat-supporting frame moves downwardly and outwardly away from the base to a boat-launch position when the swinging frame swings in an opposite direction, wherein the boat-supporting structure remains in a substantially horizontal state during up-and-down movement of the boat supporting frame; and the frame structure forming a walkway arranged for providing users with access between the shoreline and the boat-supporting structure when the boat-supporting frame is in its boat-launch position.

2. The boat lift according to claim 1 wherein the walkway includes a first walkway section formed by the swinging frame; the base forming a second walkway section; the first and second walkway sections being in general alignment with one another when the boat-supporting frame is in its boat-launch position.

3. The boat lift according to claim 2 wherein the boat-supporting frame includes vertically spaced steps to form a continuation of the walkway.

4. The boat lift according to claim 1 wherein the first and second swinging couplings define respective first and second substantially horizontal axes.

5. The boat lift according to claim 1 wherein the swinging frame assumes a generally vertical state when moved upwardly, and a generally horizontal state when move downwardly.

6. The boat lift according to claim 1 wherein the actuator includes a fluid piston-and-cylinder arrangement interconnected between the base and the swinging frame.

7. The boat lift according to claim 6 wherein the fluid piston-and-cylinder arrangement includes first and second piston-and-cylinder members arranged to operate out of phase, wherein the first piston-and-cylinder member is retracted when the second piston-and-cylinder member is extended.

8. The boat lift according to claim 1, wherein the frame structure further comprises a stabilizing structure connected to the boat supporting frame for maintaining the boat-supporting structure thereof in a horizontal state during up-and-down movement of the boat-supporting frame.

9. The boat lift according to claim 8 wherein the stabilizing structure is interconnected between the base and the boat supporting frame.

10. The boat lift according to claim 9 wherein the stabilizing structure comprises a strut having an inner end connected to the base, and an outer structure connected to the boat supporting frame.

11. A boat lift comprising:

a rigid support structure anchored on land adjacent to a body of water, the support structure including a horizontal portion disposed over the land;

a base mounted on the horizontal portion of the support structure, a frame structure for moving a boat between raised and lowered positions including:

a swinging frame including a pair of parallel, spaced-apart base arms, each base arm including an inner end mounted to the base by a first swinging coupling enabling an outer end of each base arm to swing upwardly and inwardly, or downwardly and outwardly, depending upon a direction of swinging movement of the swinging frame, a boat-supporting frame including a pair of parallel, spaced-apart support arms, each support arm including a proximate end mounted directly to an outer end of a respective base arm by a second swinging coupling, the support arms including respective remote portions arranged for supporting an underside of a boat, a stabilizing structure connected to the boat supporting frame for maintaining the remote portions in a horizontal state during up-and-down movement of the boat supporting frame; and an actuator operably connected to the frame structure for causing the swinging frame to swing relative to the base about the first swinging coupling, wherein the boat supporting frame moves upwardly and inwardly toward the base to a boat-storage position when the swinging frame swings in one direction, and wherein the boat-supporting frame moves downwardly and outwardly to a boat-launch position when the swinging frame swings in an opposite direction, and wherein the first and second swinging couplings are disposed in vertically overlying relationship to the horizontal portion of the support structure when the boat-supporting frame is in its boat-storage position.

12. The boat lift according to claim 11 wherein the frame structure forms a walkway arranged for providing users with access between the land and the remote portions when the boat-supporting frame is in its boat-launch position.

13. The boat lift according to claim 12 wherein the walkway includes a first walkway section formed by the swinging frame; the base forming a second walkway section; the first and second walkway sections being in general alignment with one another when the boat-supporting frame is in its boat-launch position.

14. The boat lift according to claim 13 wherein the boat-supporting frame includes vertically spaced steps defining a continuation of the walkway.

15. The boat lift according to claim 11 wherein the rigid support structure includes a seawall disposed on the land and extending along the body of the water, the seawall including an upright portion and a cap disposed on the top of the upright portion, a horizontal platform disposed on the land, with a front portion of the platform underlying a rear portion of the cap, the rigid support structure disposed on the platform.

16. A boat lift assembly comprising:

a seawall disposed on land and extending along a body of water, the seawall including:

an upright portion and a cap disposed on the top of the upright portion, and a horizontal platform disposed on the land, with a front portion of the platform underlying a rear portion of the cap;

a base mounted on the horizontal platform;

a frame structure for raising a boat from the water and lowering a boat into the water, the frame structure including:

a swinging frame having inner and outer ends, the inner end swingably attached to the base by a first swinging coupling, and a boat-supporting frame having proximate and remote ends, the proximate end swingably attached to the swinging frame adjacent the outer end thereof, a section of the boat-supporting frame disposed adjacent the remote end thereof defining a boat supporting structure arranged to support an underside of a boat; and an actuator operably connected to the frame structure for causing the swinging frame to swing relative to the base about the first swinging coupling, wherein the boat supporting frame moves upwardly and inwardly toward the base to a boat-storage position when the swinging frame swings in one direction, and wherein the boat-supporting frame moves downwardly and outwardly away from the base to a boat-launch position when the swinging frame swings in an opposite direction, wherein the boat-supporting structure remains in a substantially horizontal state during up-and-down movement of the boat supporting frame.

* * * * *